US008421730B2

(12) United States Patent
Wang

(10) Patent No.: US 8,421,730 B2
(45) Date of Patent: Apr. 16, 2013

(54) LCD DRIVING APPARATUS CAPABLE OF SELF-ADJUSTING DRIVE FORCE AND METHOD THEREOF

(75) Inventor: Chien Chuan Wang, Jhubei (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 818 days.

(21) Appl. No.: 12/010,451

(22) Filed: Jan. 25, 2008

(65) Prior Publication Data

US 2009/0021498 A1 Jan. 22, 2009

(30) Foreign Application Priority Data

Jul. 16, 2007 (TW) ..... 96125911 A

(51) Int. Cl.
*G09G 3/36* (2006.01)

(52) U.S. Cl.
USPC ..... 345/98; 345/87

(58) Field of Classification Search ..... 345/87, 345/92, 100, 204, 84, 104, 211, 98
See application file for complete search history.

(56) References Cited

U.S. PATENT DOCUMENTS 5,841,410 A * 11/1998 Oda et al. ..... 345/58
7,362,300 B2 * 4/2008 Hirama ..... 345/98
7,903,072 B2 * 3/2011 Yamazaki ..... 345/98
2004/0130544 A1 * 7/2004 Sun ..... 345/211
2005/0264510 A1 * 12/2005 Shimatani ..... 345/94
2006/0114247 A1 * 6/2006 Brown ..... 345/204
2007/0018938 A1 * 1/2007 Wei et al. ..... 345/100
2007/0296664 A1 * 12/2007 Kinoshita ..... 345/87

FOREIGN PATENT DOCUMENTS

CN 1773442 5/2006
CN 1901019 1/2007
JP 6-175622 6/1994
TW 200632831 A 9/2006

OTHER PUBLICATIONS

Taiwan Office Action issued by Taiwan Intellectual Property Office on Feb. 15, 2012, 10 pages.

* cited by examiner

*Primary Examiner* — Chanh Nguyen
*Assistant Examiner* — James Nokham
(74) *Attorney, Agent, or Firm* — Edell, Shapiro & Finnan, LLC

(57) ABSTRACT

The invention provides an LCD driving apparatus which can self-adjust its drive force for different LCD panels. The LCD driving apparatus comprising: a variable resistor coupled to a data line of an LCD panel for receiving an input voltage, and then outputting an output current to the data line of said LCD panel; a comparison unit coupled to the data line of the LCD panel for receiving a voltage of a display unit of the data line, and comparing the voltage with a predetermined voltage for generating a comparing result; and an adjustment unit for adjusting the variable resistor in accordance with the comparing result for changing the value of the output current.

9 Claims, 4 Drawing Sheets

LCD DRIVING APPARATUS CAPABLE OF SELF-ADJUSTING DRIVE FORCE AND METHOD THEREOF

FIELD OF THE INVENTION

The present invention is related to an LCD driving apparatus and method thereof, and more particularly to an LCD driving apparatus which can self-adjust its drive force and method thereof.

BACKGROUND OF THE INVENTION

Please refer to FIG. 1. FIG. 1 is a block diagram of the driving circuit and the LCD panel in accordance with a prior art. As shown in FIG. 1, the LCD panel module 100 is composed of data lines D1~Dm and scan lines G1~Gn arranged in a crisscross pattern. The data voltages of the data lines are provided by a source driver 11, and the scan voltages of the scan lines are provided by a gate driver 12. Each crisscrossed pair of the data lines and the scan lines is applied for controlling a display unit P. The equivalent circuit of each display unit P comprises a thin-film transistor, a storage capacitor Cs and a liquid crystal capacitor Clc. The gates and the sources of the thin-film transistors are connected to the gate line G1~Gn and the scan line D1~Dm respectively. And the drains of the thin-film transistors are connected to the storage capacitors Cs.

The conventional way of driving the LCD panel is providing scan voltages at the scan lines G1~Gn in sequence for turning on the thin-film transistors in sequence, and then providing data voltages at the data lines to charge the storage capacitors Cs and the liquid crystal capacitors Clc through the thin-film transistors in order to deflect the liquid crystal molecule. When the scan voltages of the scan lines G1~Gn are removed, the thin-film transistors are closed thereby, and the storage capacitors Cs and the liquid crystal capacitors Clc maintain the data voltages.

Commonly, there is a standard of the refresh frequency of the LCD panel, such as 60 frames per second, the driving circuit of the LCD panel has to charge the storage capacitor Cs and the liquid crystal capacitor Clc to a predetermined value in a requested period. However, different sizes of the LCD panels have different pixels with different capacitance and resistance respectively. In the formula $i^{\Delta}t=c^{\Delta}V$, the i represents the value of the current, the $^{\Delta}t$ represents the charge period, the c represents the capacitance, and the $^{\Delta}V$ represents the voltage difference. If the required $^{\Delta}V$ for the storage capacitor Cs and the liquid crystal capacitor Clc of the display units of the different size LCD panels should be the same, but the capacitance of the display units of the different size LCD panels are different and the refresh frequencies of the LCD panels are required to be the same. The only way to charge the voltage of the display unit to the predetermined voltage within the requested period is to adjust the value of the charging current.

However, the drive force, such as the value of the charging current, of the LCD driving apparatus in accordance with prior art is fixed for particular LCD panel when being manufactured. In other words, the driving apparatus is only suitable for the particular LCD panel. And it's inconvenient to provide different driving apparatus for different LCD panels respectively.

SUMMARY OF THE INVENTION

Therefore, it is one of objectives of the present invention is to provide an LCD driving apparatus which can adjust its drive force automatically according to the used LCD panel.

It is another objective of the present invention is to provide an LCD driving method, which can self-adjust its drive force for the different LCD panels.

To achieve the objective mentioned above, the present invention provides an LCD driving apparatus capable of self-adjusting drive force. The LCD driving apparatus comprises a variable resistor, a comparison unit and an adjustment unit. The variable resistor is coupled to a data line of an LCD panel for receiving an input voltage and outputting an output current to the data line of the LCD panel. The comparison unit is coupled to the data line of the LCD panel for receiving a voltage of a display unit at the data line and comparing the voltage with a predetermined voltage for generating a comparing result. The adjustment unit is for adjusting the variable resistor according to the comparing result to change the value of the output current.

Preferably, the voltage of the display unit is the voltage stored in a liquid crystal capacitor and a storage capacitor of the display unit after the liquid crystal capacitor and the storage capacitor are charged by the output current.

Besides, the present invention also provides an LCD driving method capable of self-adjusting drive force. The method comprises the steps of generating an output current to a data line of an LCD panel for charging a display unit at the data line, comparing the voltage of the display unit with a predetermined voltage for generating a comparing result, and adjusting the value of the output current according to the comparing result.

BRIEF DESCRIPTION OF THE DRAWINGS

To make it easier to understand the objectives, innovative features, performance and embodiments of the present invention, the detailed description of the attached drawings are as following.

DETAILED DESCRIPTION OF THE PREFERRED EMBODIMENTS

Figure 1:
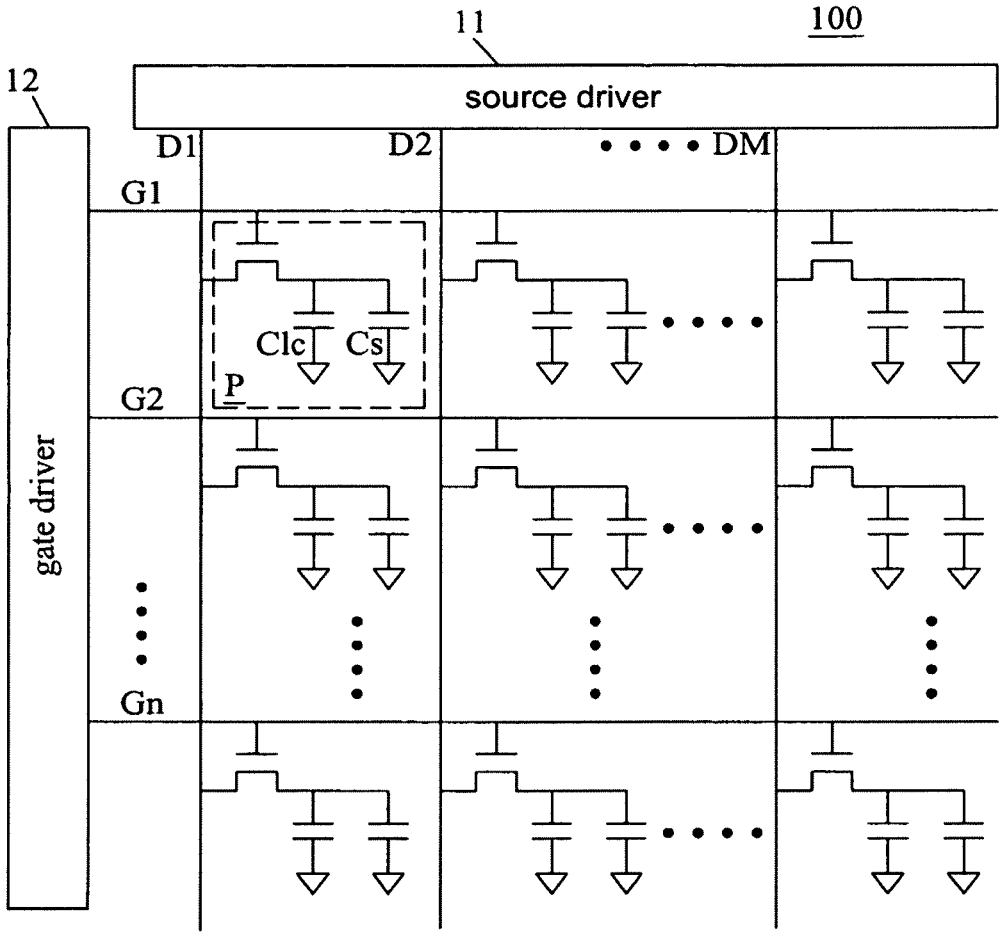
FIG.1 (PRIOR ART)
FIG. 1 is a block diagram of the equivalent circuit of the driving circuit and the LCD panel in accordance with prior art.
Figure 2:
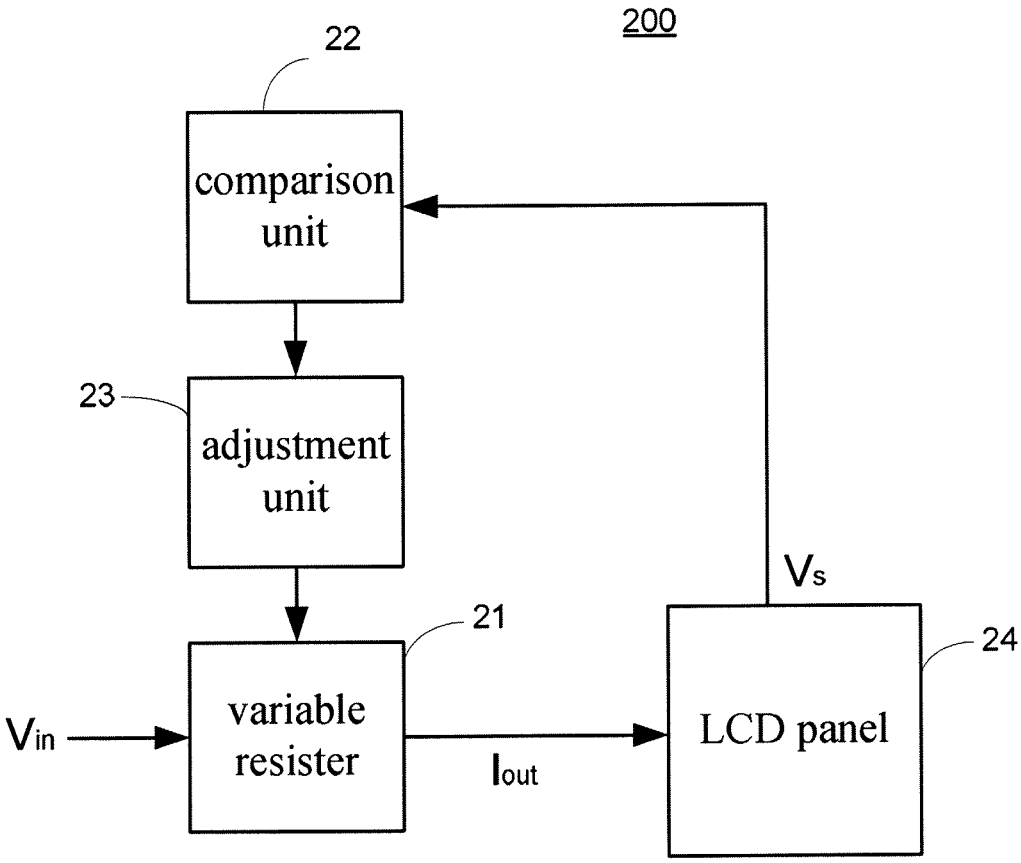
FIG. 2 is a block diagram of the LCD driving apparatus in accordance with the present invention.

FIG. 2 is a block diagram of the LCD driving apparatus in accordance with the present invention. As shown in FIG. 2, the LCD driving apparatus 200 comprises a variable resistor 21, a comparison unit 22 and an adjustment unit 23. The variable resistor 21 is for receiving an input voltage $V_{in}$ and then outputting an output current $I_{out}$ to the data line of the LCD panel 24. The output current $I_{out}$ is applied for charging the display unit of the LCD panel 24. In other words, the output current $I_{out}$ is applied for charging the storage capacitor and the liquid crystal capacitor of the display unit. The comparison unit 22 is coupled to the data line of the LCD panel 24, and for receiving a voltage of a display unit at the data line and comparing the voltage with a predetermined voltage $V_{ref}$ for generating a comparing result. The adjustment unit 23 is for adjusting the value of the variable resistor 21 according to the comparing result generated from the comparison unit 22, and then the value of the output current $I_{out}$ will be changed correspondingly. Thereby, the voltage of the display unit can be raised to an ideal predetermined value after the display unit being charged by the output current $I_{out}$ in a fixed period.

Figure 3:
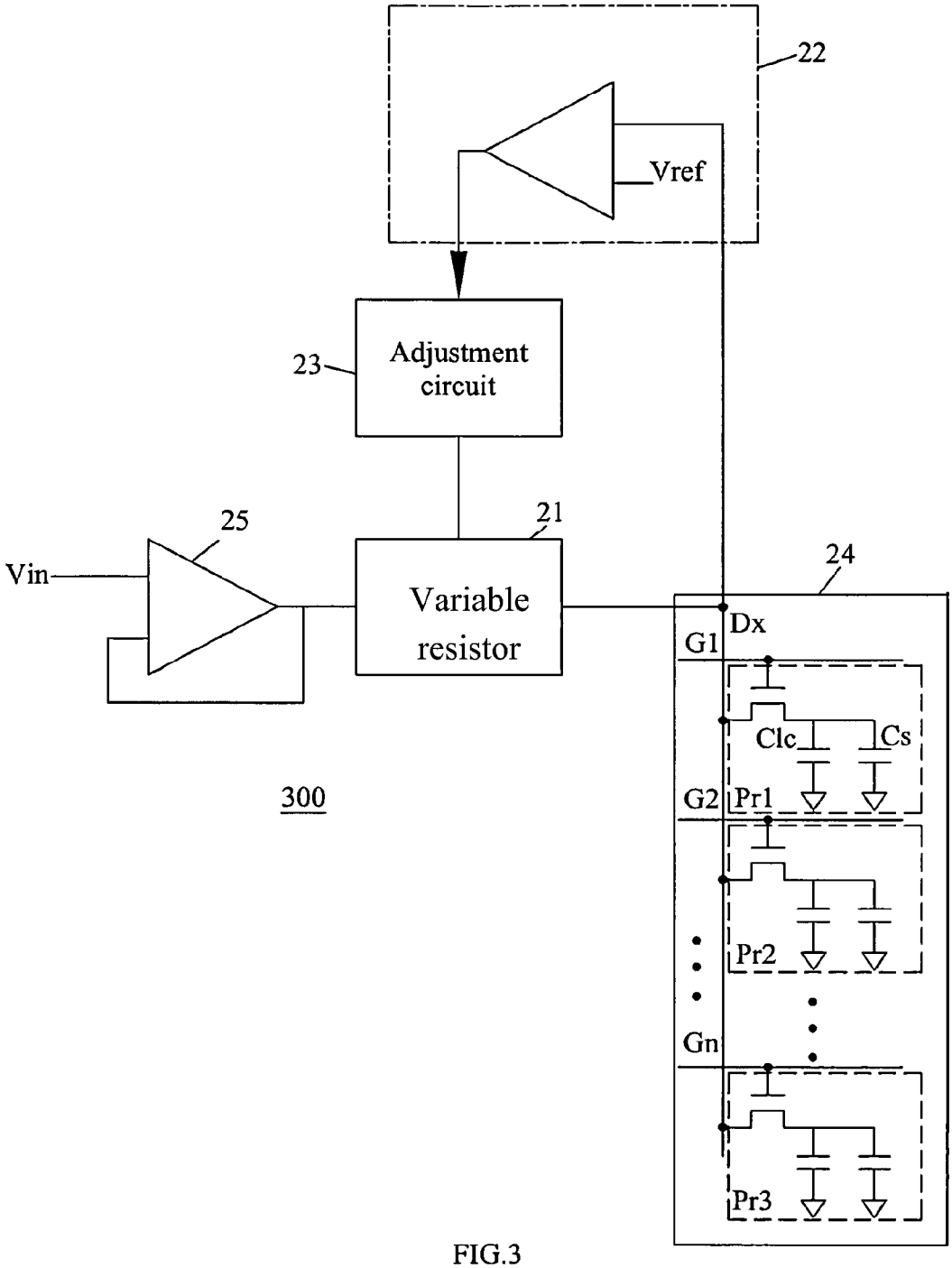
FIG. 3 is block diagram of the embodiment of the LCD driving apparatus in accordance with the present invention.

FIG. 3 is a block diagram of an embodiment of the LCD driving apparatus in accordance with the present invention. As shown in FIG. 3, the input voltage $V_{in}$ is provided to the variable resistor 21 through the buffer 25, and the variable resistor 21 is coupled to the data line of the LCD panel 24'. When one of the thin-film transistors of the display units at the data line is turned on by the scan voltage, the variable resistor 21 outputs the output current $I_{out}$ to the display unit for charging the storage capacitor and the liquid crystal capacitor of the display unit. After a period of time, the voltage of the storage capacitor and the liquid crystal capacitor of the display unit is charged to a stored voltage $V_S$. In the embodiment, the comparison unit 22 comprises a sense amplifier preferably. One input terminal of the sense amplifier is connected to a data line $D_x$ of the LCD panel, and the other input terminal of the sense amplifier is applied for receiving the predetermined voltage $V_{ref}$. The comparison unit 22 receives the stored voltage $V_S$ and compares the storing voltage $V_S$ with the predetermined voltage $V_{ref}$ for generating a comparing result. The difference between the storing voltage $V_S$ and the predetermined voltage $V_{ref}$ can be obtained according to the comparing result.

Then, the adjustment circuit 23 adjusts the variable resistor 21 according to the comparing result generated from the comparison unit 22 in order to change the value of the output current $I_{out}$ to make the stored voltage $V_S$ closer to the predetermined voltage $V_{ref}$. For instance, when the comparing result shows that the stored voltage $V_S$ is smaller than the predetermined voltage $V_{ref}$, the adjustment unit 23 can lower the resistance of the variable resistor 21, and further make the output current $I_{out}$ larger. Meanwhile, the larger output current $I_{out}$ can enlarge the stored voltage $V_S$ in the same period. When the stored voltage $V_S$ is larger than the predetermined voltage $V_{ref}$, the adjustment circuit 23 can enlarge the resistance of the variable resistor 21, and further the output current $I_{out}$ becomes lower.

When the scan voltages are applied to the scan lines G1.about.Gn in sequence, the thin-film transistors of the display units Px1.about.Pxn of the data line $D_x$ are turned on in sequence. The display unit which has been turned on can be charged by the output current $I_{out}$. Whenever the scan voltage turns on the thin-film transistor of one of the display units and the display unit is charged by the output current $I_{out}$, the comparison unit 22 performs the comparison once to compare the stored voltage $V_S$ of the display unit with the predetermined voltage $V_{ref}$, and then the adjustment unit 23 adjusts the resistance of the variable resistor 21 once according to the comparing result.

For instance, when the scan voltage is applied to the scan line G1, the comparison unit 22 compares the stored voltage $V_S$ of the display unit Px1 with the predetermined voltage $V_{ref}$, and the adjustment unit 23 adjusts the resistance of the variable resistor 21 according to the comparing result, and further adjusts the value of the output current $I_{out}$ thereby. And then, when the scan voltage is applied to the scan line G2, the display unit Px2 is charged by the output current $I_{out}$ which has been adjusted. After that, the comparison unit 22 compares the stored voltage of the display unit with the predetermined voltage again to generate another comparing result. And the adjustment unit 23 adjusts the resistance of the variable resistor 21 again according to the comparing result. Therefore, if the LCD panel has n scan lines, and the resistance can be adjusted n times in one frame to make the stored voltage $V_S$ closer to the predetermined voltage $V_{ref}$.

In one preferred embodiment, the comparison and the adjustment which are executed by the comparison unit 22 and the adjustment unit 23 are executed only at the first frame after the LCD panel is powered on, in case the LCD panel can't be operated normally. And the input voltage $V_{in}$ is a specific voltage applied for adjusting the variable resistor.

Figure 4:
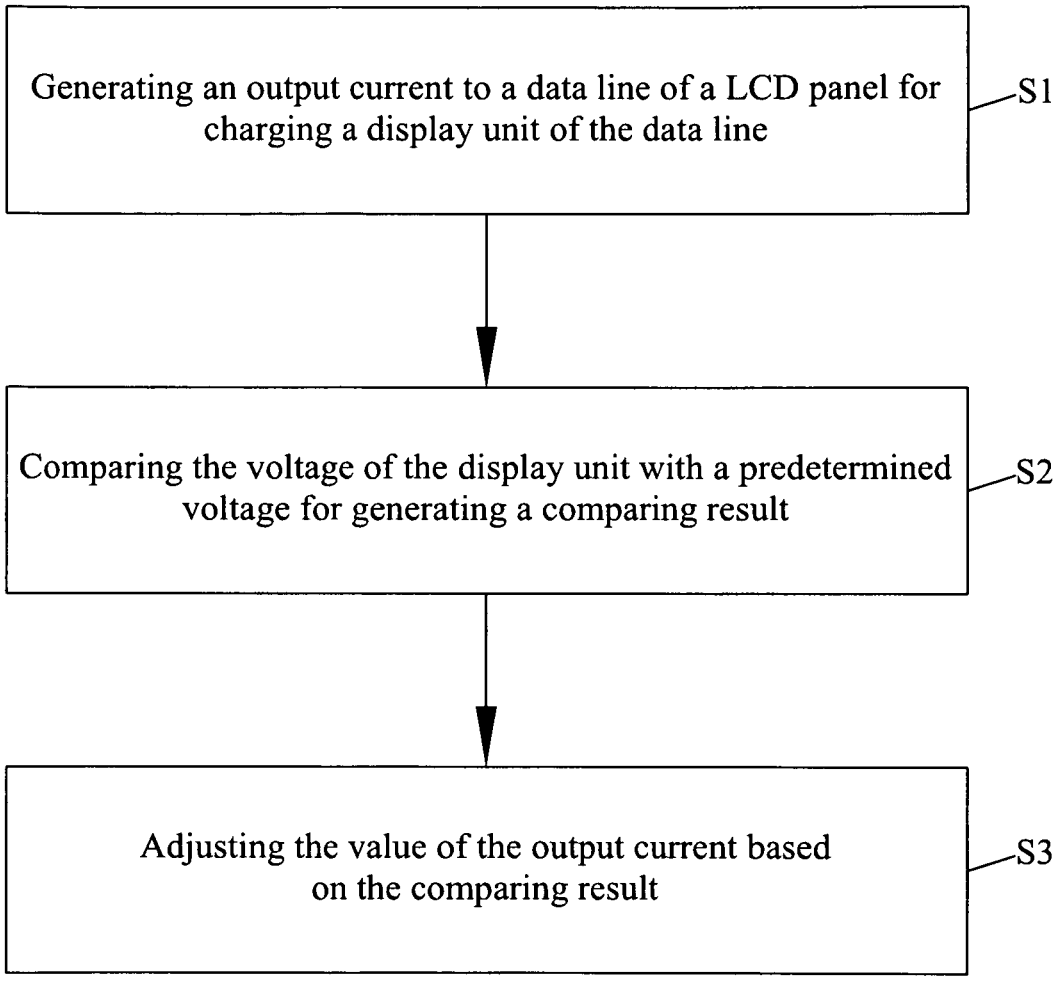
FIG. 4 is a flow diagram of the LCD driving method in accordance with the present invention.

Corresponding to the LCD driving apparatus, the present invention also provides an LCD driving method. Please refer to FIG. 4 for a flow diagram of the LCD driving method in accordance with the present invention. First, as shown in step S1, an output current is generated to a data line of an LCD panel for charging a display unit of the data line. The output current can be generated by inputting an input voltage to a variable resistor. As shown in step S2, the stored voltage of the display unit which has been charged is compared with a predetermined voltage for generating a comparing result. Finally, as shown in step S3, the value of the output current is adjusted according to the comparing result. In other words, raise the output current if the stored voltage is lower than the predetermined voltage. If the stored voltage is higher than the predetermined voltage, decrease the output current.

In the method mentioned above, when a scan voltage is applied to a plurality of scan lines of the LCD panel in sequence, the plurality of display units of the data line are turned on and charged in sequence. Execute the three steps of mentioned LCD driving method once whenever the scan voltage is inputted to one of the plurality of scan lines.

In conclusion, the LCD driving apparatus and method of present invention can self-adjust the drive force, i.e. output current, to be suitable for the different requests of the different LCD panels and to solve the drawbacks of the traditional technology.

While the present invention has been described by way of example and in terms of a preferred embodiment, it is to be understood that the present invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An LCD driving apparatus capable of self-adjusting drive force comprising:

a variable resistor including a first terminal capable of receiving an input voltage and a second terminal directly connected to a data line of an LCD panel for outputting an output current to said data line of said LCD panel;

a comparison unit including a first input terminal directly connected to said second terminal of said variable resistor for receiving a charged voltage of a display unit at said data line, and including a second input terminal directly connected to a predetermined voltage, and including an output terminal without connecting to said variable resistor, wherein said comparison unit is capable of comparing said charged voltage with a predetermined voltage for generating a comparing result at said output terminal of said comparison unit; and an adjustment unit connected to said output terminal of said comparison unit, for adjusting said variable resistor to change the value of said output current according to said comparing result, wherein when said charged voltage is smaller than said predetermined voltage, said resistance of said variable resistor is lowered for making said output current larger; and when said charged voltage is larger than said predetermined voltage, said resistance of said variable resistor is enlarged for making said output current lower.

2. The LCD driving apparatus of claim 1, wherein said charged voltage of said display unit is the voltage stored in a liquid crystal capacitor and a storage capacitor of said display unit after charged by said output current.

3. The LCD driving apparatus of claim 1, wherein when a scan voltage is inputted to a plurality of scan lines of said LCD panel in sequence, a plurality of display units at said data line are charged in sequence by said output current, said comparison unit performs a comparison once for generating said comparing result whenever one of the plurality of display units is charged, and said adjustment unit adjusts said variable resistor once according to said comparing result.

4. The LCD driving apparatus of claim 1, wherein said comparison unit comprises a sense amplifier.

5. The LCD driving device of claim 1, wherein said comparison unit and said adjustment unit are executed only at the first frame on said LCD panel after power on.

6. An LCD driving method capable of self-adjusting drive force, comprising the steps of:

providing an input voltage to a first terminal of a variable resistor and then generating an output current issued from a second terminal of said variable resistor to a data line of an LCD panel for charging a display unit at said data line;

comparing a charged voltage of said second terminal of said variable resistor with a predetermined voltage by using a comparison unit for generating a comparing result at an output terminal of said comparison unit, wherein said comparison unit includes a first input terminal directly connected to said second terminal of said variable resistor for receiving said charged voltage of said display unit at said data line, and includes a second input terminal directly connected to said predetermined voltage, and includes said output terminal without connecting to said variable resistor; and adjusting said variable resistor to change the value of said output current according to said comparing result, wherein when said charged voltage is smaller than said predetermined voltage, said resistance of said variable resistor is lowered for making said output current larger; and when said charged voltage is larger than said predetermined voltage, said resistance of said variable resistor is enlarged for making said output current lower.

7. The LCD driving method of claim 6, wherein when a scan voltage is inputted to a plurality of scan lines of said LCD panel in sequence, execute three steps of said LCD driving method once whenever said scan voltage is inputted to one of said plurality of scan lines.

8. The LCD driving method of claim 6, wherein said LCD driving method is applied only at the first frame on said LCD panel after power on.

9. The LCD driving method of claim 6, wherein said charged voltage of said display unit is the voltage stored in a liquid crystal capacitor and a storage capacitor of said display unit after charged by said output current.

* * * * *